US008608879B1

(12) United States Patent
Sabatini et al.

(10) Patent No.: US 8,608,879 B1
(45) Date of Patent: Dec. 17, 2013

(54) ENVIRONMENTALLY FRIENDLY FLARE ILLUMINANT COMPOSITION

(75) Inventors: Jesse J. Sabatini, Denville, NJ (US); Gary Chen, Succasunna, NJ (US); Amita Nagori, Rockaway, NJ (US); Reddy Damavarapu, Hackettstown, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 15 days.

(21) Appl. No.: 13/329,413

(22) Filed: Dec. 19, 2011

(51) Int. Cl.

| | |
|---|---|
| ***C06B 33/00*** | (2006.01) |
| ***C06B 33/04*** | (2006.01) |
| ***C06B 31/00*** | (2006.01) |
| ***C06B 31/02*** | (2006.01) |
| ***D03D 23/00*** | (2006.01) |
| ***D03D 43/00*** | (2006.01) |

(52) U.S. Cl.
USPC ..... 149/61; 149/37; 149/43; 149/45; 149/108.2; 149/109.2; 149/109.4; 149/109.6

(58) Field of Classification Search
USPC ..... 149/62, 37, 43, 45, 61, 108.2, 109.2, 149/109.4, 109.6
See application file for complete search history.

(56) References Cited

U.S. PATENT DOCUMENTS

| | | | | |
|---|---|---|---|---|
| 4,078,954 | A * | 3/1978 | Bernardy | 149/19.8 |
| 6,074,502 | A * | 6/2000 | Burns et al. | 149/36 |
| 8,486,207 | B2 * | 7/2013 | Webb et al. | 149/63 |
| 2010/0024932 | A1 * | 2/2010 | Webb et al. | 149/63 |

OTHER PUBLICATIONS

Carrazza, Jr. et al. (technical report 3364, Picatinny Arsenal, 1966.*

* cited by examiner

*Primary Examiner* — James McDonough
(74) *Attorney, Agent, or Firm* — Henry S. Goldfine

(57) ABSTRACT

The present invention is a flare illuminant composition, useful in hand-held signals, which composition is environmentally friendly and economical, containing a commercially available, aromatic, high energy, amine-based organic compound, 5-aminotetrazole, in place of the conventional and toxic $KClO_4$, or, for the known alternative to $KClO_4$, expensive, strontium bis-(1-methyl-5-nitriminotetrazolate)monohydrate.

2 Claims, No Drawings

ENVIRONMENTALLY FRIENDLY FLARE ILLUMINANT COMPOSITION

FEDERAL RESEARCH STATEMENT

The invention described herein may be manufactured, used, and/or licensed by the U.S. Government for U.S. Government purposes, without the payment of any royalty therefore.

FIELD OF THE INVENTION

The present invention relates to flare illuminant compositions, and particularly to such compositions formulated without any potassium perchlorate oxidizer, so as to be significantly less toxic and environmentally friendly and which compositions are also very economical.

BACKGROUND OF THE INVENTION

Hand-held signals (HHS) are devices generally used for illumination to signal troop movements, and in attracting the attention of aircraft crews. More specifically, such devices are used both day and night, to provide a beacon for rescuers, or to disclose, or illuminate the positions of military units or personnel. Such rescue or attention getting applications are common in non-military situations, as well as, in military combat and training scenarios. Generally, HHS formulations contain significant amounts of potassium perchlorate ($KClO_4$), a strong oxidizing material—which exothermically transfers oxygen to combustible materials, to provide pyrotechnics with a significant rate of combustion in air. However, $KClO_4$ contaminates groundwater and impacts public drinking water. $KClO_4$ interferes with hormonal regulation of the thyroid gland, and is known to be teratogenic. Accordingly, the US Environmental Protection Agency has established a permissible $KClO_4$ level at 15 parts per billion, and various states have mandated even lower levels, e.g. California has mandated no more that 6 parts per billion and Massachusetts has mandated only 2 parts per billion. In response, the US Department of Defense is spending billions of dollars annually on perchlorate remediation efforts.

Colors in pyrotechnics are obtained by the addition of specific ingredients, which offer the desired flame color. For example, green is obtained with the addition of barium nitrate, which acts as both a color agent and an oxidizer. Similarly, strontium nitrate provides intense red and also acts as an oxidizer. The corresponding light emitting species (in the gas phase, during flaming) are the monohydroxides, SrOH and BaOH, and the monochlorides, SrCl and BaCl, for red and green. Therefore, as stated above, commonly in red or green pyrotechnics, potassium perchlorate ($KClO_4$) is used—as, a chloride ion and hydroxide ion donor, which also is a strong oxidizer.

One HHS of particular interest is the U.S. Army red signal/illuminating device; the M126A1 parachute. The $KClO_4$-containing in-service M126A1 red signal/illuminating device has a required military specification of a minimum burn time of 50 seconds, a minimum luminous intensity of 10,000 candela, a dominant wavelength of 620±20 nanometers and a minimum spectral purity of 76%. This red military illuminant device is housed within a 10 inch aluminum handheld launch tube, propelled therefrom by a fin stabilized rocket, and floats back to earth suspended from a parachute—providing the desired red illumination or signal as it floats downward. The fin stabilized rocket assembly propels the illuminant device to an altitude of about 700 feet, after which an expelling charge ignites the illuminant and, as stated, the assembly parachutes to the ground.

As stated above, $KClO_4$ acts as an oxidizer, and is so used in the M126A1 illuminant; where, with a second oxidizer, strontium nitrate ($Sr(NO_3)_2$), the $KClO_4$ reacts with a 1:1 mixture of magnesium 30/50 and magnesium 50/100, inorganic fuel, to produce magnesium oxide (MgO). MgO is a gray body emitter, and is responsible for producing the necessary illumination intensity desired for the HHS (intensity measured in candela). Further, the reaction of the strontium with the chloride donor from another ingredient, polyvinyl chloride (PVC), to produce strontium (I) chloride (SrCl). SrCl is responsible for imparting the intense red color within the pyrotechnic material, though the strontium reacting with the oxidizer to produce strontium monohydroxide (SrOH) also contributes to the red emission. An organic-basedbinder, usually Laminac/Lupersol, mitigates the sensitivity and prevents separation of the oxidizer, fuel and chloride donor.

Disclosed by Sabatini et al, Propellants, Explosives, Pyrotechnics, Applications of High-Nitrogen Energetics in Pyrotechnics: Development of Perchlorate-Free Red Star M126A1 Hand-Held Signal Formulations with Superior Luminous Intensities and Burn Times, August 2011, Vol. 36, Issue 4, pp. 373-378 (Wiley-VCH Verlag GmbH & Co., KGaA, Weinheim), available online at: http://onlinelibrary-.wiley.com/doi/10.1002/prep.201000061/pdf, is an alternative to $KClO_4$ based illuminant formulations for use in HHS, which involves the use of a metal salt, with a strontium core and two nitro groups, i.e. strontium bis-(1-methyl-5-nitriminotetrazolate)monohydrate—a high energy, high nitrogen fuel. While a synthesis of strontium bis-(1-methyl-5-nitriminotetrazolate)monohydrate is disclosed in an article by Thomas M. Klapötke et al., Propellants, Explosives, Pyrotechnics, Coloring Properties of Various High-Nitrogen Compounds in Pyrotechnic Compositions, June 2010, Vol. 35, Issue 3, pp 213-219 (Wiley-VCH Verlag GmbH & Co., KGaA, Weinheim), use of such a synthesis is not amenable to mass, economic production and strontium bis-(1-methyl-5-nitriminotetrazolate)monohydrate is not commercially available.

Clearly there is a need in the art for an inexpensive, commercially available, environmentally friendly, and non-toxic alternative to $KClO_4$ in flare compositions, especially for HHS illuminants.

SUMMARY OF INVENTION

The present invention comprises the use of an environmentally friendly, economical, commercially available, aromatic, amino-organic compound, 5-aminotetrazole, as the high energy, organic fuel in a flair illuminant composition, useful in a HHS-substituting for the conventional and toxic $KClO_4$, or, for the known alternative to $KClO_4$, expensive strontium bis-(1-methyl-5-nitriminotetrazolate)monohydrate. Surprisingly, in a conventional M126A1 HHS formulation, such a substitution of the inventive 5-aminotetrazole for $KClO_4$, with the addition of a moderate increase in the quantity of inorganic fuel, i.e. from 28.4 to 41.4 percent, provided a 39% increase in luminosity, from about 17,195 candela to about 23,859 candela. Further, this environmentally benign 5-aminotetrazole formulation, with its 39% increase in luminosity, had comparable purity of spectral and burn time characteristics as the prior art $KClO_4$ formulation.

The particular red flare composition, i.e. HHS illuminant formulation of the present invention is comprised of strontium nitrate, from about 35 to about 50 parts; magnesium (equal parts 30/50 and 50/100 mesh powder), from about 30 to about 48 parts; polyvinyl chloride (PVC), from about 12 to about 18 parts; 5-aminotetraole, from about 2 to 5 parts; and a binder, preferably Epon 813/Versamid 140, from about 4 to 7 parts.

In formulating the present inventive flare composition, useful as a red HHS illuminant, the ingredients are merely mixed under ambient conditions. Preferably, the binder is first mixed with the magnesium; the 5-aminotetrazole is then mixed in; the PVC and strontium nitrate are then mixed in (which two ingredients can be premixed and added together—all mixing is done until a uniform mixture is obtained (wherein about 10 to about 20 minutes mixing can be required to obtain a uniform mixture). With the use of the preferred Epon 813/Versamid 140 binder system, the final mixture should be allowed to sit, consolidate, for about 1 to about 3 hours—whereupon it can be pressed into the desired illuminant form (the prior Laminac 4116/Lupersol binder system required curing for a 10 to 12 hour period in an oven, at about 140 degrees F., prior to pressing).

The nature of the subject invention will be more clearly understood by reference to the following detailed description and the appended claims.

DETAILED DESCRIPTION OF THE INVENTION

The present invention comprises a flare illuminant pyrotechnic composition, useful in HHS formulations, in which 5-aminotetrazole is substituted for the conventional strong potassium perchlorate ($KClO_4$) oxidizer. Because $KClO_4$ decomposes in an exothermic manner, removing it from the M126A1 formulation results in a significant loss of energy of the pyrotechnic mixture and associated intensity of the formulations illumination. The 5-aminotetrazole substitute releases environmentally benign nitrogen gas ($N_2$) upon combustion. Due to the release of $N_2$, the pyrotechnic system is able to maintain the lost energy due to the removal of $KClO_4$. Further, the use of 5-aminotetrazole as the $KClO_4$ replacement does not degrade the desired spectral purity of the pyrotechnic formulation or the burn time thereof. In fact, surprisingly, due to the presence of 5-aminotetrazole and the nominal increased quantity of magnesium used (i.e. from 29.4% to 41.4%), a significant enhancement of the luminous intensity is observed, as the $KClO_4$-containing M126A1 formulation has a luminous intensity of about 17,195 candela, while the 5-aminotetrazole-containing formulation has a luminous intensity approximately 39% higher with a value of about 23,859 candela.

A conventional $KClO_4$ baseline HHS formulation composition (AN-1158), for a red flare HHS illuminant is shown in Table 1, left column, next to a 5-aminotetrazole formulation of the present invention, right column—the burn times were substantively equal. The formulations were generally the same, except the inventive formulation had a nominal additional quantity of magnesium, about 12 weight %, 6 weight % less $Sr(NO_3)_2$, and substituted the 5-aminotetrazole for the potassium perchlorate ($KClO_4$)—the use of one binder system vs. another has no significant effect on the resulting luminous intensity, dominant wavelength or the spectral purity. And, as shown, surprisingly, the illumination intensity of the $KClO_4$ baseline HHS formulation (AN-1158) was only about 17,195 candela—while the luminous intensity of the 5-aminotetrazole formulation of the present invention was almost 24,000 (specifically, 23,859 candela)—an increase of about 39%. The dominant wavelength of the AN-1158 formulation was 613.1 nanometers, with an 88.6% purity—while that of the 5-aminotetrazole formulation was 614.7 nanometers, with a 91.5% purity (not meaningful differences).

TABLE 1

Conventional $KClO_4$ HHS formulation vs. 5-aminotetrazole formulation

| | | | |
|---|---|---|---|
| Magnesium 30/50 (fuel) | 14.7% | Magnesium 30/50 (fuel) | 41.4% |
| Magnesium 50/100 (fuel) | 14.7% | — | |
| Strontium Nitrate (oxidizer) | 39.3% | Strontium Nitrate (oxidizer) | 33.3% |
| Polyvinyl Chloride ($Cl^-$ donor) | 14.7% | Polyvinyl Chloride ($Cl^-$ donor) | 14.7% |
| Potassium perchlorate (oxidizer, & chloride ion & hydroxide ion donor) | 9.8% | 5-aminotetrazole (high nitrogen fuel) | 3.8% |
| Binder - 95% Laminac 4116/5% Lupersol | 6.8% | Binder (see Note A, below) | 6.8% |

Note A: Either 95% Laminac 4116/5% Lupersol or 80% Epon 813/20% Versamid 140; wherein Laminac 4116 is a thermoset polyester styrene available from Ashland Chemical; Lupersol is a trademark of Arkema, Inc., Philadelphia, Pa., for liquid compounds containing organic peroxides in combination with organic or inorganic fillers; and Epon is a low viscosity bisphenol-A based epoxy resin diluted with cresyl glycidyl ether, available from Momentive Specialty Chemicals, Inc., Columbus, Ohio. Versamid 140, a cross-linking polyamine is available from Cognis (now part of BASF), Florham Park, N.J.

Note B: All values given in Table 1, are "about" the percentages shown.

The values for the relative quantities of the chemical ingredients given in Table 1 are the most preferred values, the subject invention can be formulated with the relative quantities presented in Table 2, below.

TABLE 2

Alternative formulations of the present invention.

| | Weight Percentage | Preferred Wt. Percentage |
|---|---|---|
| Magnesium 30/50 (fuel) | 35 to 50% | 38 to 45% |
| Strontium Nitrate (oxidizer) | 25 to 40% | 30 to 35% |
| Polyvinyl Chloride ($Cl^-$ donor) | 12 to 18% | 13 to 17% |
| 5-aminotetrazole (high nitrogen fuel) | 2 to 5% | 3.5 to 4.5% |
| Binder (see Note A, above) | 4 to 8% | 6 to 7.5% |

Note C: all values given in Table 2 are "about" the percentages shown.

Red flare compositions according to the present invention, that are useful as HHS illuminants, can be prepared by first, drying in an oven all of the chemical constituents of the subject illuminant—overnight at 60° C., and then weighed out according to their weight percentages in the formulation given above (see Table 1, with most preferred percentages—parts per hundred—and Table 2, with broadest percentage ranges and preferred percentage ranges). A binder system, i.e. either the conventional 95% Laminac 4116/5% Lupersol, or the 80% Epon 813/20% Versamid 140 disclosed in the Sabatini et al, Propellants, Explosives, Pyrotechnics, Applications of High-Nitrogen Energetics in Pyrotechnics: Development of Perchlorate-Free Red Star M126A1 Hand-Held Signal Formulations with Superior Luminous Intensities and Burn Times article discussed above, was introduced into a Hobart air mixing bowl, Hobart, Troy, N.Y., and was vigorously mixed by hand with a wooden tongue depressor for 2 min. All fuels, the magnesium and 5-aminotetrazole, were simultaneously added into the bowl, and the mixture was blended with the aid of a B-blade at 207 kPa for 10-20 min. The air was turned off and the oxidizer (strontium nitrate) was added into the bowl, and the pyrotechnic mixture was blended, with air, for 10-20 min. at 207 kPa. The air was turned off, the inside of the mixing bowl was scraped with the B-blade to remove the pyrotechnic material sticking to the sides of the bowl, and the mixture was again blended, with air, for 10-20 min. at 207 kPa. The pyrotechnic mixture was poured from the air mixer bowl to a large ceramic bowl. Laminac 4116/Lupersol-based formulations were dried in the oven overnight to ensure full curing, and Epon 813/Versamid 140-based formulations were dried in air for 2-3 h at ambient temperature to ensure partial curing before consolidation. There was no difference in the reported results between the Laminac 4116/Lupersol-based formulations and the Epon813/Versamid 140-based formulations.

The subject Mg 30/50 was purchased from Reade, Providence, R.I., and the Mg 50/100 was purchased from Magnesium Elektron, Flemington, N.J. $KClO_4$, $Sr(NO_3)_2$, and PVC was purchased from Hummel Croton Inc., South Plainfield, N.J. 5-Aminotetrazole was purchased from Sigma-Aldrich, St. Louis, Mo. Laminac 4116 was purchased from Ashland Chemical, Inc., Covington, Ky. Lupersol was purchased from Norac, Azusa, Calif. Epon 813 was purchased from Hexion Specialty Chemicals, now Momentive Specialty Chemicals, Columbus, Ohio. Versamid 140 was purchased from Cognis, a part of BASF, Florham Park, N.J. All tested formulations were encased in non-coated Kraft fiberboard tubes, obtained from Security Signals, Inc., Cordova, Tenn.

Burn times and optical emissive property, i.e. the luminous intensity, of the prior art, conventional $KClO_4$ HHS formulation and the inventive 5-aminotetrazole formulation were characterized using both a single element photopic light detector and a 2048 element optical spectrometer. The light detector we used was manufactured by International Light and is composed of a SED033 silicon detector (33 $mm^2$ area silicon detector with quartz window) coupled to a photopic filter (Y-filter) and a field of view limited hood (H-hood). The current output of the detector was converted to voltage using a DL Instruments 1211 transimpediance amplifier. Voltage output was collected and analyzed from the amplifier using a NI-6115 National Instruments datacard and in-house developed Labview™ based data acquisition and analysis software.

The optical emissive spectrum of each composition sample discussed herein was measured using a 2048 element Ocean Optics HR2000 spectrometer, Ocean Optics, Dunedin, Fla., coupled to a 400 micron core optical fiber. The dominant wavelength and spectral purity was measured based on the 1931 CIE method using illuminant C as the white reference point. The spectrometer was calibrated using both an Hg—Ar light source (Ocean Optics HG-1 wavelength standard) and a calibrated tungsten light source (Ocean Optics LS-1-Cal). The dominant wavelength and spectral purity based on the full burn time of the sample was calculated.

Each composition formulation discussed herein was weighed out in three 30 g increments, and was pressed into noncoated Kraft fiberboard tubes (length of 8.13 cm.; inner diameter of 4.93 cm) with a manual hand press at a consolidation dead load of 3,409 kg. Between 89.9-90.1 g of energetic material was used per candle, three candles were prepared for each formulation, and the candles were dried overnight in the oven at 60° C. After being conditioned in the oven, a thin layer of thermite-based igniter slurry in acetone was applied to the top of each candle. After the candles were dried in the oven at 60° C. for 2 h to evaporate the acetone, they were ignited with an electric match in the light tunnel with an energy source of 2 amperes.

Example 1

A red flare illuminant composition, according to the present invention, and useful as a HHS illuminant formulation, JS-1457, was prepared using the chemical ingredients detailed in Table 3, below:

TABLE 3

| | |
|---|---|
| Magnesium 30/50 (fuel) | 35.4% |
| Strontium Nitrate (oxidizer) | 39.3% |
| Polyvinyl Chloride (Chlorine⁻ donor) | 14.7% |
| 5-aminotetrazole (high nitrogen fuel) | 3.8% |
| Epon 813/Versamid 140 | 6.8% |

The JS-1457 was tested, per the methodology described above and found to have a burn time of 57.7 seconds; a luminous intensity of 17,684.3 candela; a dominant wavelength of 615.4 nanometers; and a spectral purity of 91.5%.

Example 2

A second flare illuminant composition, according to the present invention, and useful as a HHS illuminant formulation, JS-1459, was prepared using the same chemical ingredients detailed in Table 3 above, with the quantity of strontium nitrate lowered 6% and the quantity of magnesium 30/50 raised 6%—no other change. The result was a surprising increase in luminous intensity to 23,858 candela. The burn time was 54.8 seconds, still acceptable; the dominant wavelength was 614.7; and the spectral purity was 91.5%—acceptable values.

Based upon these Examples and the discussion above, it is clear that the subject inventive $KClO_4$-free, flare illuminant composition, useful in a HHS illuminant formulation—using the environmentally friendly, commercially available, economical 5-aminotetrazole formulation—with a quantity of magnesium powder higher than previously known for such an application—provides α, desirable, very significant increase in luminous intensity. This increase is about 39% greater (i.e. 23,859 candela) than the current, conventional $KClO_4$ HHS formulation of 17,194.9 candela. The disclosed 5-aminotetrazole formulations also had acceptable burn times, dominant wavelength and spectral purity values.

We claim:

1. A flare illuminant composition, useful in hand held illuminant formulations, comprising:

a. about 41.4 weight percent of Magnesium 30/50;

b. about 33.3 weight percent of Strontium Nitrate;

c. about 14.7 weight percent of Polyvinyl Chloride;

d. about 3.8 weight percent of 5-aminotetrazole; and e. about 6.8 weight percent of a binder system; and f. wherein said composition is free of potassium perchlorate and free of strontium bis-(1-methyl-5-nitiminotetrazolate)monohydrate.

2. The flare illuminant composition of claim 1, wherein:

the composition has a luminous intensity of about 23,859 candela.

* * * * *